US011515111B2

(12) United States Patent
Pedemonte et al.

(10) Patent No.: US 11,515,111 B2
(45) Date of Patent: Nov. 29, 2022

(54) ACTUATOR DEVICE FOR CHANGE OF STATE OF AN ELECTRONIC-CONTROL APPARATUS FOR UNDERWATER USE, AND CORRESPONDING SYSTEM

(71) Applicant: CRESSI-SUB S.p.A., Genoa (IT)

(72) Inventors: Stefano Pedemonte, Genoa (IT); Giuseppe Marenco, Genoa (IT)

(73) Assignee: Cressi-Sub S.P.A., Genoa (IT)

( * ) Notice: Subject to any disclaimer, the term of this patent is extended or adjusted under 35 U.S.C. 154(b) by 0 days.

(21) Appl. No.: 17/052,388

(22) PCT Filed: May 14, 2019

(86) PCT No.: PCT/IB2019/053984
§ 371 (c)(1),
(2) Date: Nov. 2, 2020

(87) PCT Pub. No.: WO2019/220338
PCT Pub. Date: Nov. 21, 2019

(65) Prior Publication Data

US 2021/0175034 A1 Jun. 10, 2021

(30) Foreign Application Priority Data

May 15, 2018 (IT) ..... 102018000005373

(51) Int. Cl.
*H01H 36/00* (2006.01)
*H01H 9/04* (2006.01)
*H01H 36/02* (2006.01)

(52) U.S. Cl.
CPC ..... *H01H 36/006* (2013.01); *H01H 9/04* (2013.01); *H01H 36/02* (2013.01)

(58) Field of Classification Search
CPC ..... H01H 36/006; H01H 9/04; H01H 36/02
See application file for complete search history.

(56) References Cited

U.S. PATENT DOCUMENTS 3,267,414 A 8/1966 Kritz
3,445,796 A * 5/1969 Kolless ..... H01H 1/66 335/205

(Continued)

OTHER PUBLICATIONS

Patent Cooperation Treaty, International Search Report and Written Opinion for International Application No. PCT/IB2019/053984, 8 pages, Sep. 7, 2019.

*Primary Examiner* — Bernard Rojas
(74) *Attorney, Agent, or Firm* — Blank Rome LLP

(57) ABSTRACT

The invention relates to an actuator device for change of state of an electronic-control apparatus for underwater use and a system for underwater use comprising the combination of a said actuator device with an electronic-control apparatus for underwater use. The actuator device for change of state of an electronic-control apparatus for underwater use comprises a main body designed to be associated in a stable way with at least part of said apparatus. A peculiarity of the invention is that it comprises, associated with the main body, magnetic-field generator means that interface, in the operating position of the actuator device, with reed-technology sensor means of said apparatus for sending electrical information to means for management and control of the apparatus that are designed to change the state, in particular the state of supply of the apparatus, said management and control means being electrically associated with a supply circuit of the apparatus, which comprises at least one power-supply battery, for the possible opening or closing of the circuit.

6 Claims, 2 Drawing Sheets

(56) References Cited

U.S. PATENT DOCUMENTS

| | | | | | |
|---|---|---|---|---|---|
| 3,794,825 | A | | 2/1974 | Krupansky | |
| 4,152,755 | A | | 5/1979 | Nixt et al. | |
| 5,010,529 | A | | 4/1991 | Maynus | |
| 5,369,386 | A | * | 11/1994 | Alden | H01H 36/0066<br>335/206 |
| 7,504,919 | B1 | * | 3/2009 | Tittle | H01H 13/06<br>335/151 |
| 9,754,739 | B2 | * | 9/2017 | Honda | H01H 36/00 |
| 10,290,453 | B2 | * | 5/2019 | Trandal | H01H 33/53 |

* cited by examiner

ACTUATOR DEVICE FOR CHANGE OF STATE OF AN ELECTRONIC-CONTROL APPARATUS FOR UNDERWATER USE, AND CORRESPONDING SYSTEM

CROSS-REFERENCE TO RELATED APPLICATIONS

This application claims priority to PCT International Application No. PCT/IB2019/053984 filed on May 14, 2019, which application claims priority to Italian Patent Application No. 102018000005373 filed on May 15, 2018, the disclosures of which are expressly incorporated herein by reference.

STATEMENT RE: FEDERALLY SPONSORED RESEARCH/DEVELOPMENT

Not applicable.

DESCRIPTION

The subject of the present invention is an actuator device for change of state of an electronic-control apparatus for underwater use in combination with an electronic-control apparatus.

By "change of state" of the electronic-control apparatus we mean the change of operating state thereof, in particular transition between a state where it is supplied and a state where it is not supplied, through opening or closing, respectively, of a corresponding electrical supply circuit.

The sector of the invention is in underwater applications, i.e., in electronic-control apparatuses and instrumentation suited for underwater use and hence subject to considerable pressures.

Electronic-control apparatuses and instrumentation for underwater use present a series of features that are peculiar in order to achieve their purposes, amongst which the need for the batteries that supply the electrical equipment thereof to last as long as possible. The batteries are typically arranged in housings and recesses provided with appropriate high-pressure hydraulic seals, the performance of which, as is known, may decay when the batteries are removed and replaced.

Consequently, in the context of underwater use, there is felt the problem of supplying the electrical equipment of the electronic-control apparatuses and having it functioning for the time strictly necessary for its use and with the maximum possible energy saving in order to limit as far as possible the need to replace the batteries.

An attempt has been made to provide a solution to this technical problem by providing the apparatuses with devices and/or programs for managing, turning on, and turning off the electrical equipment, which, however, substantially limit and condition usability thereof. For instance, the apparatuses are equipped with physical on and off pushbuttons, which, however, require an operator to operate them prior to use of the equipment, thus complicating construction of the apparatus and therefore increasing the costs involved.

Devices of this sort are, for example, known from the U.S. Pat. Nos. 5,010,529, 4,152,755, 3,794,825 and 3,267,414.

Alternatively, there exist apparatuses equipped with sensor means suited for automatic turning-on and turning-off of the electrical equipment, which, however, call for continuous monitoring by a corresponding electronic system for management and control of the apparatuses; this means that the management and control system is always on and hence uses electric power for this purpose, a fact that contributes to draining of the batteries. In the case where the apparatuses are stored for a long time, the problem is even more evident and important.

The aim of the present invention is to overcome the drawbacks of the prior art mentioned above and to provide an actuator device for change of state of an electronic-control apparatus and system for underwater use that will be highly efficient in achieving energy saving of the batteries used in the apparatus.

A purpose of the invention is to implement an actuator device that is built in a simple and rational way and presents reliable and automatic operation when connected up to the corresponding apparatus.

A further aim is to demand of the electronic-control apparatus minimal consumption of electricity from the batteries in every condition of operation, especially when it is stowed away in a condition of non-use.

SUMMARY OF INVENTION

To achieve the aforesaid aims, the subject of the present invention is an actuator device for enabling change of state of an electronic-control apparatus for underwater use, as well as a system for underwater use having the characteristics specified the annexed claims.

In one embodiment, the invention regards an actuator device for change of state of an electronic-control apparatus for underwater use, comprising a main body designed to be associated in a stable way with at least part of said apparatus. The actuator device comprises, associated with the main body, magnetic-field generator means that interface, in the operating position of the actuator device, with reed-technology sensor means of the apparatus itself for sending electrical information to means for management and control of the apparatus that are designed to change the state of supply thereof, the management means being electrically associated with a supply circuit of the apparatus, which comprises at least one power-supply battery, in order to enable opening or closing of the circuit.

Consequently, when the actuator device is in the operating position, the means for management and control of the apparatus receive an electrical pulse due to the interaction between the magnetic-field generator means, for example a permanent magnet, and the reed-technology sensor means, for example a simple reed contact, so that the management and control means receive the information that the actuator device is in the operating position, for example by detecting a current generated by simple closing of an electrical circuit, so that they implement the command for interrupting the supply circuit, thus saving the battery power.

Advantageously, the invention makes it possible to obtain a control of management of the state of the apparatus that is reliable and efficient, with an automatic change of state in the various operating conditions, in particular a change of state between supply and non-supply of the electronic-control apparatus.

Advantageously, the above control of management is obtained using simple means equipped with a particularly well-tested and reliable technology.

The invention is hence simple to implement and can be applied to any type of electronic-control apparatus and instrumentation for underwater use, with only slight and far from invasive modifications thereto.

BRIEF DESCRIPTION OF THE FIGURES

Further purposes, characteristics, and advantages of the present invention will emerge clearly from the ensuing detailed description of preferred embodiments of the invention, provided purely by way of explanatory and non-limiting example, with the aid of the annexed drawings, wherein.

DETAILED DESCRIPTION

Figure 1:
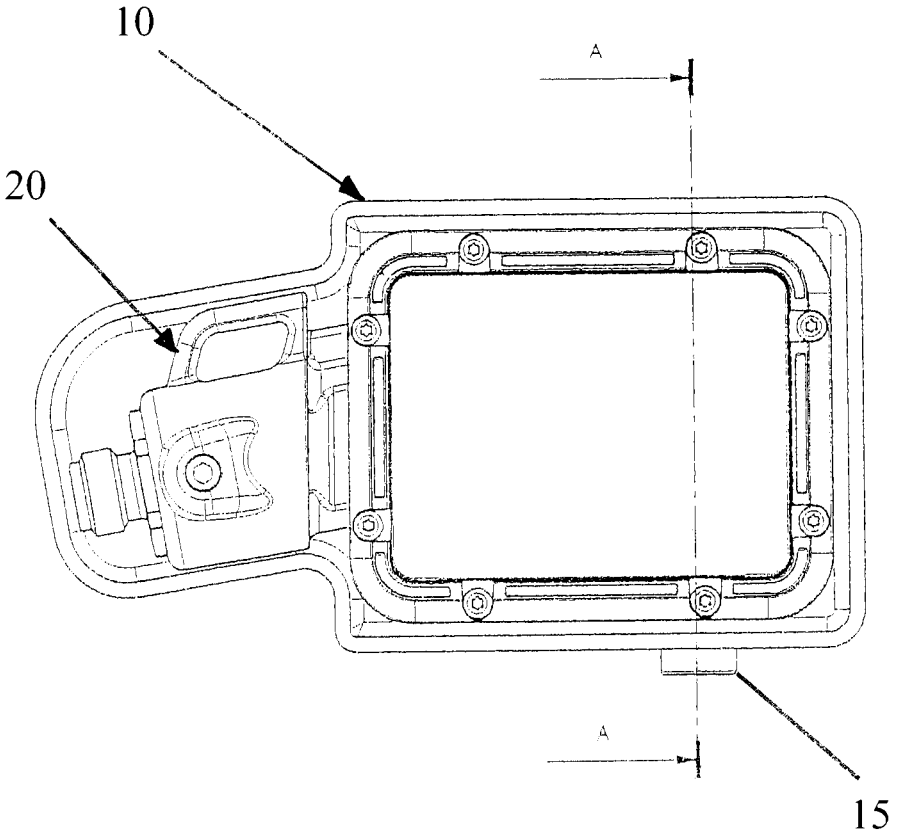
FIG. 1 is a top plan view of a system for underwater use including an electronic-control apparatus for underwater use and an actuator device for change of state thereof, according to an embodiment of the present invention.
Figure 2:
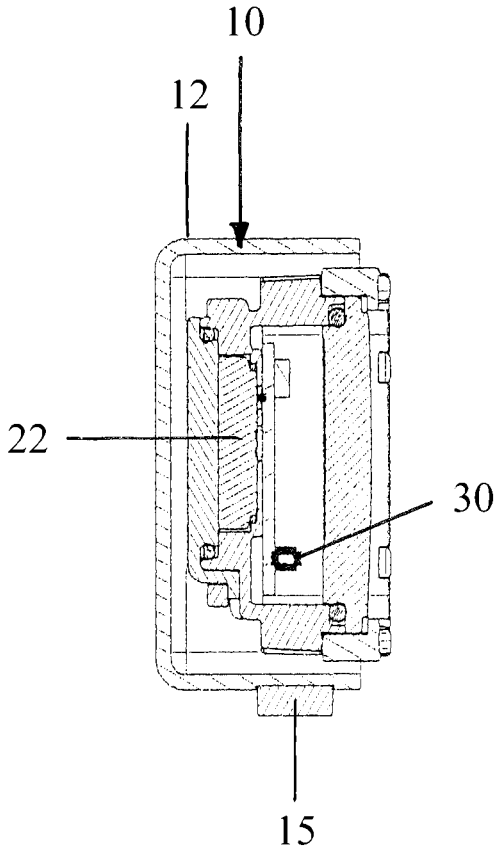
FIG. 2 is a view according to the section A-A of the system of FIG. 1.
Figure 3:
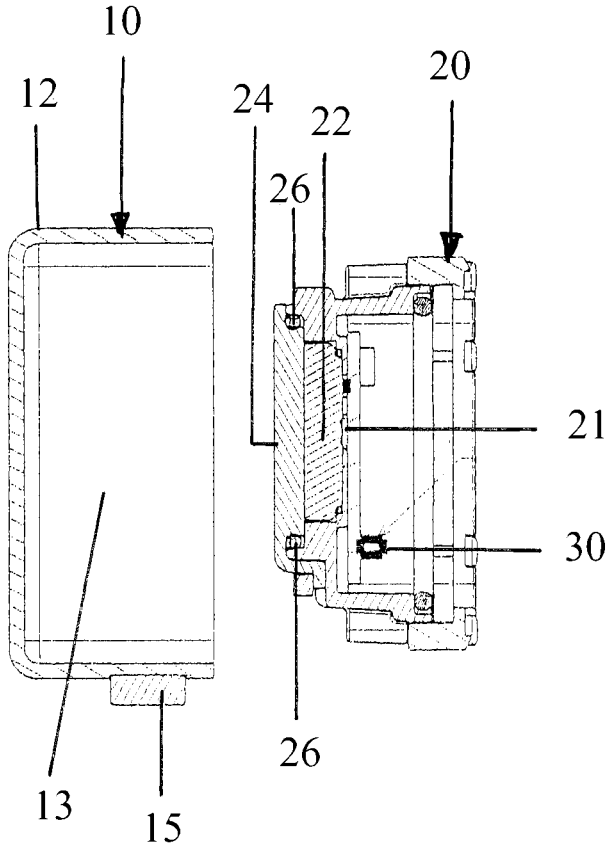
FIG. 3 is an exploded view according to the section A-A of the system of FIG. 1 in an inoperative condition of the actuator device.

With reference to FIGS. 1-3, designated as a whole by 10 is an actuator device for change of state of an electronic-control apparatus for underwater use, the apparatus being in turn designated as a whole by 20 and comprising:

a main body 12 designed to be associated in a stable way with at least part of the aforesaid apparatus 20, magnetic-field generator means 15 associated with the main body 12, which interface, in the operating position of the actuator device 10 as in FIGS. 1 and 2, with reed-technology sensor means 30 of the apparatus 20 for sending electrical information to means for management and control of the apparatus 20, which are designed to change state, in particular the state of supply, of the apparatus 20, the means for management and control of the apparatus being in turn electrically associated with a supply circuit of the apparatus 20, which comprises at least one power-supply battery 22, for closing it or opening it thus enabling turning-on or turning-off of the apparatus (ON/OFF); or else, for opening or closing (ON/OFF) of an electrical circuit of the apparatus 20 electrically associated with a supply circuit thereof, which comprises at least one power-supply battery 22, thus enabling turning-on or turning-off of the apparatus.

Consequently, when the actuator device 10 is in the operating position, the magnetic-field generator means, in the example, a permanent magnet 15, interact with the reed-technology sensor means 30, for example a simple reed contact, and generate an electrical signal, which is received by the management and control means of the apparatus 20, which receive the information that the actuator device 10 is in the operating position, for example by detecting a current generated by closing of the reed contact 30.

The magnetic-field generator means 15 are thus possibly able to control a change of state of the apparatus, in particular interruption of the supply circuit, advantageously saving battery energy.

The actuator device 10 according to the invention is consequently designed for the passage of the electronic-control apparatus 20 from a state of supply ON, in particular when it is not in the operating position, with its main body 12 stably associated with the apparatus 20, to a state of non-supply OFF, when instead the possibility described in the previous paragraphs arises, and vice versa.

The electronic-control apparatus for underwater use 20, for example a manometer for measuring the depth of immersion or the pressure and the amount of mixture present in the cylinders, further comprises:

a battery compartment 21, which is in electrical connection with said supply circuit and is designed to house the batteries 22;

a hatch 24 for closing the battery compartment 21, of a hermetically sealed type via interposition of hydraulic seals 26 designed for withstanding high pressures;

a video display 28 in electrical connection with the means for management and control of the apparatus 20 for display of information detected by the apparatus 20; and reed-technology sensor means, for example a simple reed contact 30 associated with the supply circuit for sending binary information to the management and control means of the apparatus 20, designed to change the state of the apparatus 20, in particular the state of supply thereof.

The main body 12 of the actuator device 10 is at least in part shaped like an obligate housing 13, which is able to contain a part or all of the apparatus 20, in the example almost the entire apparatus 20 except for the display 28. The obligate housing 13 is shaped in such a way as to adhere to at least part of the apparatus 20, enclosing it in tight mutual contact. Advantageously, said obligate housing 13 is firmly fixed to at least part of the apparatus 20 without any need for further specific means suited to the purpose, hence in an extremely practical, simple, and efficient way.

In an embodiment of the invention, the magnetic-field generator means of the actuator device are constituted by an electromagnet in electrical connection with actuator means for emitting time-variable magnetic pulses, in particular according to an established logic, which stimulate the reed-technology sensors of the apparatus that close or open, with the aforesaid established logic, an electrical circuit connected thereto. The means for management and control of the apparatus are designed to receive the above time-variable pulses of the electrical circuit and to establish in which operating condition the electronic-control apparatus is, as well as to govern accordingly a change of state of the apparatus, in particular opening or closing of the supply circuit. Consequently, the management and control means receive the encoded electrical information and advantageously establish in which operating condition the apparatus is, for example, whether it is undergoing programmed maintenance or it is in other particular conditions of use and/or testing, consequently governing a change of state of the apparatus, in particular opening and/or closing of the supply circuit according to the need.

Advantageously, the above solution enables perfect and rational management of the energy present in the batteries, which is used only when it is strictly necessary.

Also in this embodiment of the invention, the actuator device is evidently designed for bringing about passage of the electronic-control apparatus from a state of supply ON to a state of non-supply OFF, and vice versa.

It is clear that, for a person skilled in the art, numerous additional variants may be made to the actuator device for change of state of an electronic-control apparatus and to the system for underwater use according to the invention, as likewise it is clear that, in its practical embodiment, the shape of the particular items illustrated may differ and that the items may be replaced by technically equivalent elements.

The invention claimed is:

1. A system for underwater use, comprising:

an electronic-control apparatus, the electronic-control apparatus being a manometer configured to measure a depth of underwater immersion or an underwater pressure, the electronic-control apparatus comprising:

a battery compartment configured to house batteries, the battery compartment electrically communicating with a supply circuit of the electronic-control apparatus;

a hatch configured to close the battery compartment, the hatch being of a hermetically sealed type via interposition of high-pressure hydraulic seals; and a video display, in electrical communication with a management and control mechanism of the electronic-control apparatus, configured to display information detected by the electronic-control apparatus;

an actuator device configured to change a state of the electronic-control apparatus, the actuator comprising:

a main body configured to be associated in a stable way with at least part of said electronic-control apparatus, where said actuator device has an inoperating condition, where said main body of said actuator device is completely separated from said electronic-control apparatus, and has an operating condition, where said actuator device is associated in a stable way with said at least part of said electronic-control apparatus, wherein the main body is shaped, at least in part, like an obligate housing, the main body configured to house at least part of the electronic-control apparatus, and configured to adhere to at least part of the electronic-control apparatus; and a magnetic-field generator associated with said main body that, in the operating condition of the actuator device, interfaces with a reed-technology sensor of said electronic-control apparatus for sending electrical information to the management and control mechanism of the electronic-control apparatus that is configured to change a state of supply of the electronic-control apparatus, said management and control mechanism being electrically associated with the supply circuit of the electronic-control apparatus, said management and control mechanism comprising at least one power-supply battery, for the possible opening and closing of the supply circuit.

2. The system according to claim 1, wherein the magnetic-field generator of the actuator device comprises an electromagnet in electrical connection with an emitter for emission of time-variable magnetic pulses, where the time-variable pulses stimulate the reed-technology sensor.

3. The system according to claim 1, wherein the actuator device is configured for bringing about passage of the electronic-control apparatus from an ON state to an OFF state, and vice versa.

4. The system according to claim 1, wherein the management and control mechanism of the electronic-control apparatus is configured to receive time-variable magnetic pulses from said magnetic-field generator and to establish in which operating condition the electronic-control apparatus is, as well as to drive an opening or closing of the supply circuit.

5. The system according to claim 1, wherein the magnetic-field generator associated with said main body is a magnet, that, in the inoperating condition of the actuator device, does not interface with the reed-technology sensor of said electronic-control apparatus, and fails to send electrical information to the management and control mechanism of the electronic-control apparatus.

6. The system according to claim 1, wherein, in the operating condition, the main body of the actuator device contains the electronic-control apparatus.

* * * * *